US008006619B1

(12) United States Patent
Kuklinski et al.

(10) Patent No.: US 8,006,619 B1
(45) Date of Patent: Aug. 30, 2011

(54) UNDERWATER ACOUSTIC TRACER SYSTEM

(75) Inventors: Robert Kuklinski, Portsmouth, RI (US); Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 313 days.

(21) Appl. No.: 12/383,433

(22) Filed: Mar. 13, 2009

(51) Int. Cl.
*F42B 15/22* (2006.01)

(52) U.S. Cl. ..... 102/399

(58) Field of Classification Search ..... 102/399, 102/346; 114/20.1, 23, 21.3
See application file for complete search history.

(56) References Cited

U.S. PATENT DOCUMENTS 2,513,279 A * 7/1950 Bradley ..... 89/1.11
3,041,992 A * 7/1962 Lee ..... 114/312
3,205,846 A * 9/1965 Lang ..... 114/67 A
3,723,951 A * 3/1973 Kush et al. ..... 367/93
4,429,652 A * 2/1984 Stol ..... 114/20.1
6,739,266 B1 * 5/2004 Castano et al. ..... 102/399
7,373,883 B1 * 5/2008 Gieseke ..... 102/399
7,392,733 B1 * 7/2008 Kuklinski et al. ..... 89/5
7,428,870 B1 * 9/2008 Nedderman ..... 102/399
7,690,309 B1 * 4/2010 Kuklinski ..... 102/399

* cited by examiner

*Primary Examiner* — Michael Carone
*Assistant Examiner* — Reginald Tillman, Jr.
(74) *Attorney, Agent, or Firm* — James M. Kasischke; Michael P. Stanley; Jean—Paul A. Nasser

(57) ABSTRACT

An underwater supercavitating projectile includes means to form ripples on its surrounding cavity so as to provide well-defined disturbances of the cavity boundary. As the ripples move aft of the supercavitating projectile and into the wake behind the advancing projectile, the ripples detach to form a pattern of vapor bubbles in the wake that are distinct in both size and regularity from the typical vapor bubbles formed as the cavity collapses behind the advecting projectile. Sensors record the track of the projectile along its path based on the distinct acoustic signature of the vapor bubbles. Combined with the acoustic echo from a target, the relative distance of the projectile to the target can be determined using methods known in the art. Multiple projectile trajectories are used to increase the ability to resolve the target by adjusting the aiming of the projectiles to reduce the relative distance.

15 Claims, 7 Drawing Sheets

UNDERWATER ACOUSTIC TRACER SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention relates to underwater targeting and tracing systems and more specifically to systems and methods for controlling and utilizing supercavitating projectile dynamics to produce a distinctive radiated noise signal.

(2) Description of the Prior Art

There exists a need for accurate localization of underwater targets for a variety of underwater systems. The basic means of identification of an underwater object or target usually relies on the transmission of an acoustic signal from a fixed location and processing of a return echo at that same location. As in the case of an in-air tracer bullet, when launching a plurality of high velocity underwater projectiles against a target, it would be desirable to trace the path of a number of such projectiles so as to localize the proximity of the projectile stream on the intended target.

The art for tracing underwater high speed objects previously has been limited to measuring the speed of relatively small metallic objects which travel relatively closely to a magnetic pickup. For larger, high speed, underwater projectiles, supercavitating underwater vehicles have been proposed for use. The conditions for supercavitation are known in the art. Supercavitation allows for higher speeds to be sustainable by reducing skin friction drag to a great extent at such higher speeds.

Proposed means for tracking larger underwater high speed objects, such as a supercavitating vehicle, rely on a number of hoops aligned on a range in the anticipated path of the high speed projectile. The hoops are sufficiently large relative to the size of the projectile and anticipated path. Each hoop contains a number of independent hydrophones. The signals from the hydrophones may be analyzed to accurately determine position and track of an underwater projectile along the plane of each hoop. The system may be used as a fixed range or as a mobile range in a remote location. However, since the hoops must be placed in the anticipated path of the projectile, such means do not aid in localizing the proximity of a projectile stream on an intended target.

Systems and methods are needed that can produce radiated acoustic signals from the projectile in the near vicinity of the targeted object. In order to properly distinguish the radiated acoustic signals from the projectile so as to accurately track its path, the signals can be designed to be either greater in amplitude or easier to characterize than would a transmitted signal from the receiver or target location.

By providing a distinguishable acoustic signal, the systems and methods can provide better resolution of underwater vehicle position and improved tracking of an underwater object. The ability to more effectively target underwater objects moving at high speed may be enhanced through better resolution of underwater objects and tracks in poor acoustic environments.

The distinguishable acoustic signal of the systems and methods herein can lead to decreased signal processing requirements to achieve a desired target resolution and a better ability to resolve multiple targets. Accordingly, the systems and methods may be particular effective in conjunction with projectile-based terminal defense systems, mine clearance systems, stand alone gun systems for augmenting existing targeting systems, and the like.

SUMMARY OF THE INVENTION

It is therefore a general purpose and primary object of the present invention to provide systems and methods for controlling the cavity dynamics of a supercavitating underwater projectile to produce a distinctive radiated noise signal. The distinctive noise signal may then be used in conjunction with an underwater targeting system to help identify, localize and track targets.

The object of the present invention is attained by modifying a supercavitating projectile to provide a well-defined, prescribed disruption of its surrounding cavity. The disruptions, in turn, can produce well characterized acoustic signals that contain unique features that interact with the acoustic environment and aid in the identification of underwater objects.

In operation, a supercavitating projectile can be fired toward a target from a firing platform. The projectile can include rippling means that cause one or more ripples to form on the cavity boundary so as to provide well-defined disturbances of the cavity boundary. As the projectile advects through the water, the ripples move aft of the supercavitating projectile at the speed of advance. As the ripples move into the wake, the ripples detach to form a pattern of vapor bubbles in the wake that are distinct in both size and regularity from the typical vapor bubbles formed as the cavity collapses behind the advecting projectile. This distinction in the pattern of vapor bubbles results in a distinct acoustic signature.

Sensors can record the track of the projectile along its path based on the distinct acoustic signature. Combining this information with the acoustic echo from the target, the relative distance of the projectile to the target can be determined using methods known in the art. The aiming of the supercavitating projectiles towards the target can be adjusted to reduce the relative distance. As in the case of using tracer bullets in air to lock onto a target, multiple projectile trajectories can be used to increase the ability to resolve the target.

The rippling means may be varied to produce differing patterns of ripples and hence vapor bubbles. Thus, a variety of distinct sound fields may be created. The rippling means may be in the form of a mechanical actuator that can be extended from the projectile to contact the cavity boundary and cause a ripple to be created. Depending on the extent to which the actuator contacts the cavity boundary and the shape of the actuator, various sizes of ripples and hence vapor bubbles can be formed. Additionally, the actuator can contact the cavity boundary in a specified sequence to produce a corresponding specified pattern of vapor bubbles.

Supercavitating projectiles with flammable cores, which are ignited upon launch, are known in the art. Combustion of the core causes a flame front to move from the aft end toward the cavitator, or forward end, of the projectile. For such projectiles, a number of small bores can extend through the outer casing of the projectile and penetrate into the core. As the flame front reaches each bore, a pressure disturbance is created, which causes a ripple to form. As in the case of a mechanical actuator, ripples from the pressure disturbance result in vapor bubbles forming and a distinct sound field can be created. The number, size and spacing of the bores are chosen to produce ripples of varying size and frequency. The rate of flame front propagation can determine the rate of ripple formation and, as such, additional distinguishing characteristics of the acoustic signal can be produced.

In one embodiment, an underwater targeting system comprises a supercavitating projectile launched towards a target that includes a rippling means for providing the projectile with a distinct acoustic signature. An acoustic sensor receives first acoustic signals based on the distinct acoustic signature. The acoustic sensor also receives second acoustic signals based on an echo of the distinct acoustic signature from the target when the projectile approaches the target. An acoustic processor resolves the trajectory of the projectile based on the first acoustic signals and resolves the relative distance between the projectile and the target based on the first and second acoustic signals.

In one variation, the acoustic processor is attuned to the distinct acoustic signature so as to preferentially resolve the trajectory and relative distance. The acoustic sensor may also or separately be attuned to the distinct acoustic signature so as to preferentially receive the first and second signals.

In another variation, the rippling means forms one or more disturbances at a cavity boundary of the supercavitating projectile. The disturbances separate from the cavity boundary to form vapor bubbles in the wake of the projectile. The collapse of the vapor bubbles results in the distinct acoustic signature of the projectile.

The rippling means can be programmed to form a predetermined series of disturbances, with the disturbances having a specified timing, shape and/or size.

The rippling means can include an actuator and a controller. The controller can direct the movement of the actuator so as to disturb the flow within a cavity surrounding the projectile. The disturbed flow results in the formation of the disturbances. In one variation, the controller extends the actuator into the flow. In another variation, the movement of the actuator pivots a control surface of the projectile into the flow. In yet another variation, the movement of the actuator opens a port one the projectile to the flow.

In a further variation, the rippling means includes a flammable core within the projectile and one or more bores in the projectile, which expose the core to the cavity surrounding the projectile. The passage of the flame front of the flammable core by a bore disturbs the flow within the cavity, which results in the formation of a disturbance at the cavity boundary. The size of the bores, the location of the bores and/or the flame rate of the flammable core can be varied to form a predetermined series of disturbances.

In one embodiment, a supercavitating projectile comprises an actuator and a controller, which directs the movement of the actuator to disturb a flow within a cavity surrounding the supercavitating projectile. The disturbed flow forms one or more disturbances at a cavity boundary of the projectile. These disturbances separate from the cavity boundary to form vapor bubbles in the wake of the supercavitating projectile. The collapse of the vapor bubbles results in a distinct acoustic signature.

In one variation, the controller extends the actuator into the flow. In another variation, the movement of the actuator pivots a control surface of the projectile into the flow. In yet another variation, the movement of the actuator opens a port on the projectile to the flow.

In one embodiment, a supercavitating projectile comprises a flammable core and one or more bores in said projectile. The bores expose the core to a cavity surrounding the projectile. Passage of the flame front of the flammable core by a bore disturbs a flow within the cavity and the disturbed flow forms one or more disturbances at the cavity boundary of the projectile. The disturbances separate from the cavity boundary to form vapor bubbles in the wake of the projectile. Collapse of the vapor bubbles results in a distinct acoustic signal.

In one variation, a size of the bores, a location of the bores and/or a flame rate of the flammable core can be varied to form a predetermined series of disturbances.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE INVENTION

Figure 1:
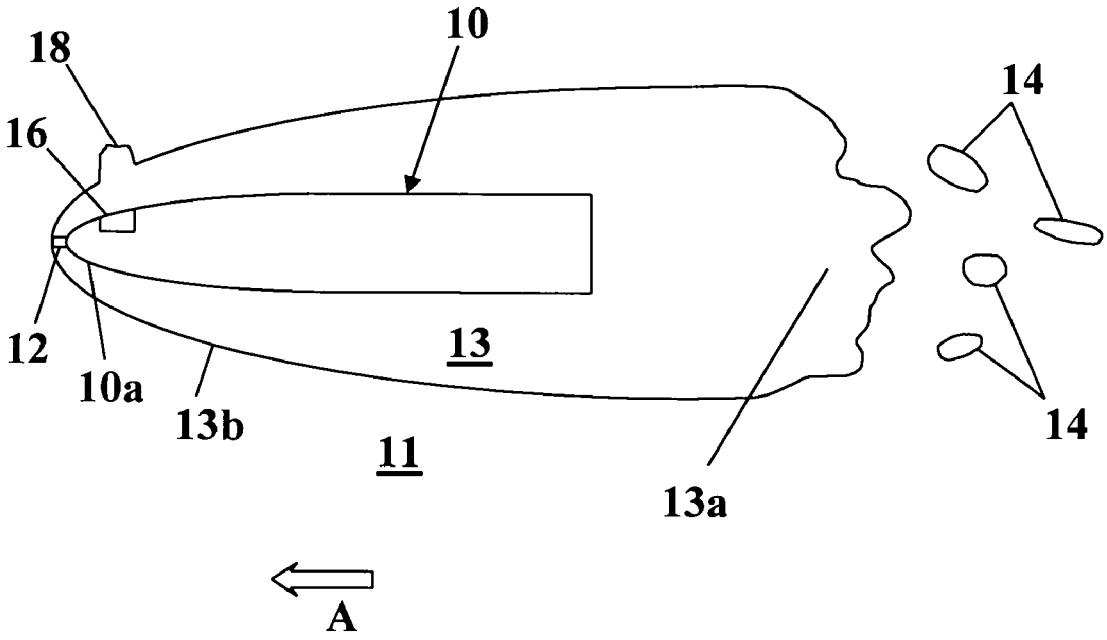
FIG. 1 illustrates a side view of an underwater projectile advecting through a medium.

Referring now to FIG. 1, there is shown a side view of underwater projectile 10 advecting through a fluid medium 11 in the direction indicated by arrow A. For ease of reference, but not limitation, medium 11 may be described herein as water. As is known in the art, water 11 is accelerated over a cavitator 12 attached to a nose portion 10*a* of vehicle 10. The downstream pressure drops below the vapor pressure of water 11 after passing cavitator 12, resulting in the formation of cavity 13, through which projectile 10 traverses.

Cavity 13 terminates in a cavity closure region 13*a*. Cavity closure region 13*a* is usually well defined spatially but is not steady. Quasi-steady rupture of cavity closure region 13*a* produces a trail of vaporous bubbles 14 behind closure region 13*a*. Bubbles 14 ultimately collapse and produce a large amplitude radiated acoustic signal.

The characteristics of radiated signals from collapsing bubbles are known in the art. However, the acoustic signature of projectile 10 does not lend itself to tracking since the formation of bubbles 14, as illustrated in FIG. 1, is chaotic. To provide a more well-defined and distinguishable acoustic signature, projectile 10 includes rippling means 16, shown schematically in FIG. 1, which forms disturbance 18 in boundary 13*b* of cavity 13. The operation of rippling means 16 and its formation of a disturbance in boundary cavity 13*b* will be discussed in further detail with respect to FIGS. 5 and 6. For illustrative purposes and not for limitation, the formation of disturbance 18 in FIG. 1 is taken as time $t_0$.

Figure 2A:
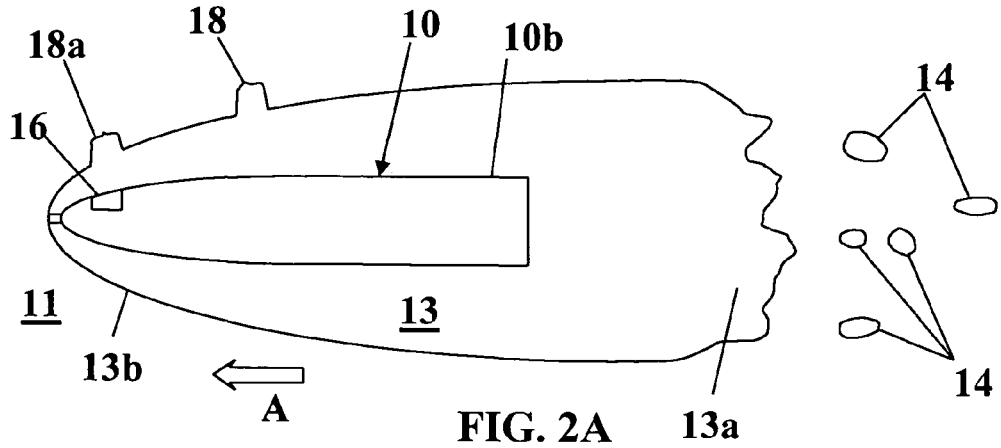
FIGS. 2A-2C illustrate the formation of ripples at the cavity boundary of the supercavitating projectile and its progression along the cavity.
Figure 2B:
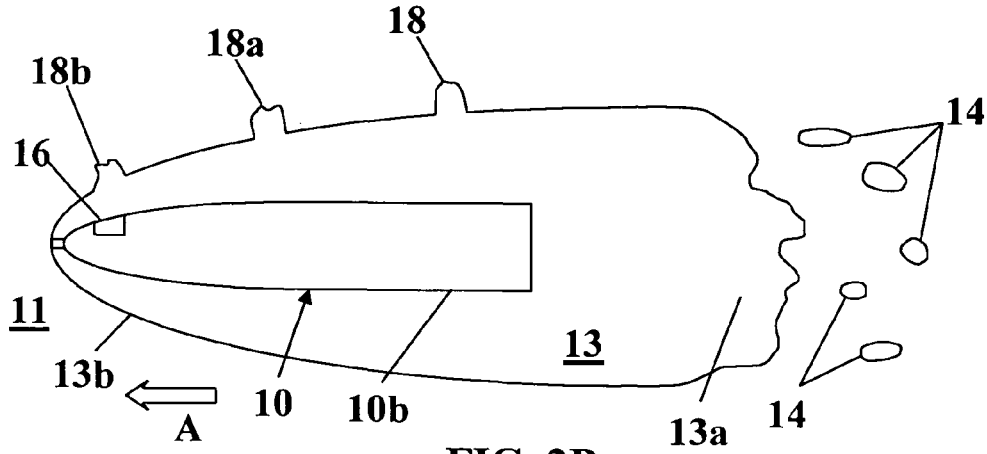
Figure 2C:
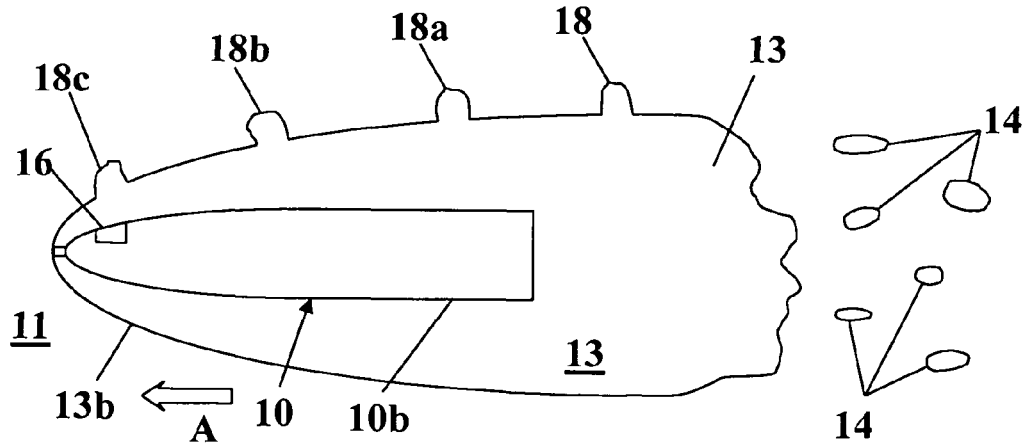

FIG. 2A, FIG. 2B and FIG. 2C illustrate projectile 10 at subsequent times $t_1$, $t_2$ and $t_3$, respectively. In FIG. 2A, disturbance 18 is shown at a position further towards aft end 10*b* of projectile 10 as a result of projectile 10 advecting through medium 11 for time $t_1-t_0$. Additionally, FIG. 2A illustrates rippling means 16 forming disturbance 18*a*.

In FIG. 2B, disturbances 18 and 18*a* are shown at positions still further towards aft end 10*b* of projectile 10 as a result of projectile 10 advecting through medium 11 for time $t_2-t_1$. Additionally, FIG. 2B illustrates rippling means 16 forming disturbance 18*b*.

Correspondingly at time $t_3$, FIG. 2C illustrates disturbances 18, 18*a* and 18*b* at positions still further towards aft end 10*b* of projectile 10 and the formation of disturbance 18*c* by rippling means 16. FIGS. 2A-2C further illustrate the continuing chaotic formation of bubbles 14 as projectile 10 advects through medium 11.

As can be seen in FIGS. 2A-2C, rippling means 16 forms a series of disturbances (18-18*c*) at boundary 13*b*. The operation of rippling means 16 can be such that the disturbances (generally referred to herein as 18) formed by rippling means 16 are regularly shaped and spaced at boundary 13*b*. The advection or movement of projectile 10 through medium 11 results in such consistent disturbances 18 progressing towards cavity closure region 13*a*.

Figure 3A:
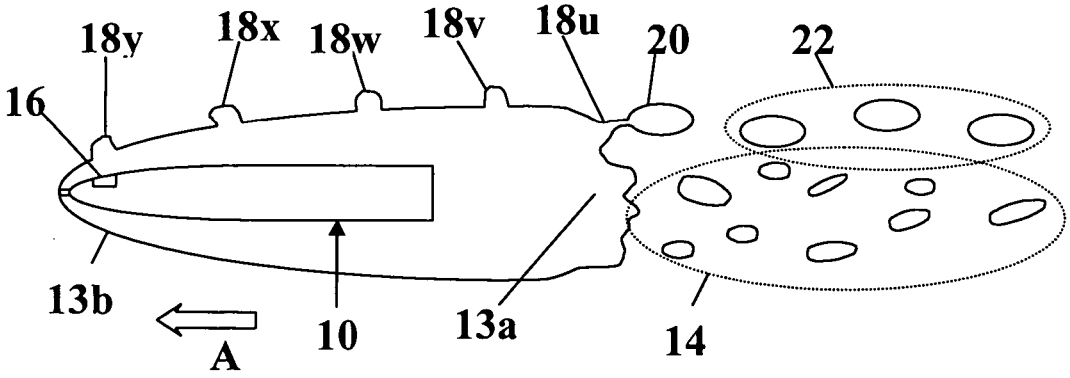
FIGS. 3A and 3B illustrate the formation of ripples and vapor bubbles.

Referring to FIG. 3A, there is shown projectile 10 at a time $t_z$ subsequent to time $t_3$ of FIG. 2C. Rippling means 16 has formed additional disturbances 18*u*-18*y* at boundary 13*b* in the manner shown in FIGS. 2A-2C. Disturbances 18*u*-18*y* can be formed periodically or in a time encoded manner. FIG. 3A illustrates disturbance 18*u* at cavity closure region 13*a*, such that disturbance 18*u* is in the process of separating from cavity boundary 13*b* and forming disturbance bubble 20. Additionally, FIG. 3A illustrates a trail or pattern of disturbance bubbles 22 having been formed by disturbances separated from boundary 13*b* previous to time $t_z$. As a result of the regularity, or uniformity of disturbances 18, the pattern of disturbance bubbles 22 is distinct from that of typical vapor bubbles 14. This difference in size and regularity of formation result in a distinct acoustic signature for the pattern of disturbance bubbles 22.

Figure 3B:
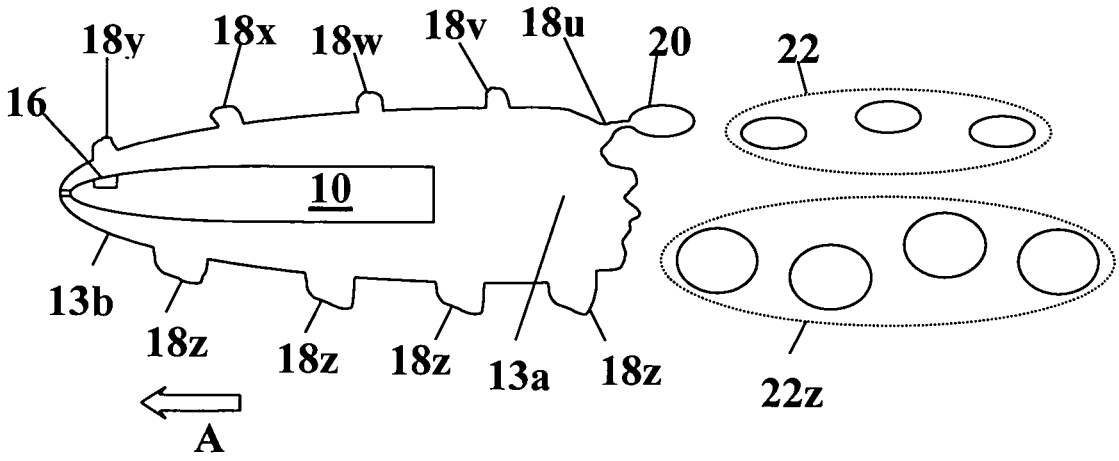

Referring also to FIG. 3B, there is shown projectile 10 of FIG. 3A, wherein rippling means 16 is operated to form additional disturbances 18*z*. For ease of illustration, but not limitation, disturbances 18*z* are shown formed on cavity boundary 13*b*, opposite from disturbances 18*u*-18*y*. Disturbances 18*z* have a distinct size and shape from that of disturbances 18*u*-18*y*, resulting in a pattern of disturbance bubbles 22*z* distinct from that of the pattern of disturbance bubbles 22 and further distinct from that of typical vapor bubbles 14. For clarity, but not limitation, vapor bubbles 14 are not shown in FIG. 3B.

Thus, projectile 10 can produce a variety of distinct bubble patterns, depending on the operation of rippling means 16. Those of skill in the art can readily determine the acoustic signatures resulting from such distinct bubble patterns. Accordingly, acoustic sensors can be sensitized to the particular characteristics of the distinctive acoustic signature of the projectile. Similarly, acoustic processors can be optimized for resolving the distinctive acoustic signature amongst other acoustic input. Thus, the path of the projectile can be preferentially tracked to assist in targeting projectiles.

Figure 4:
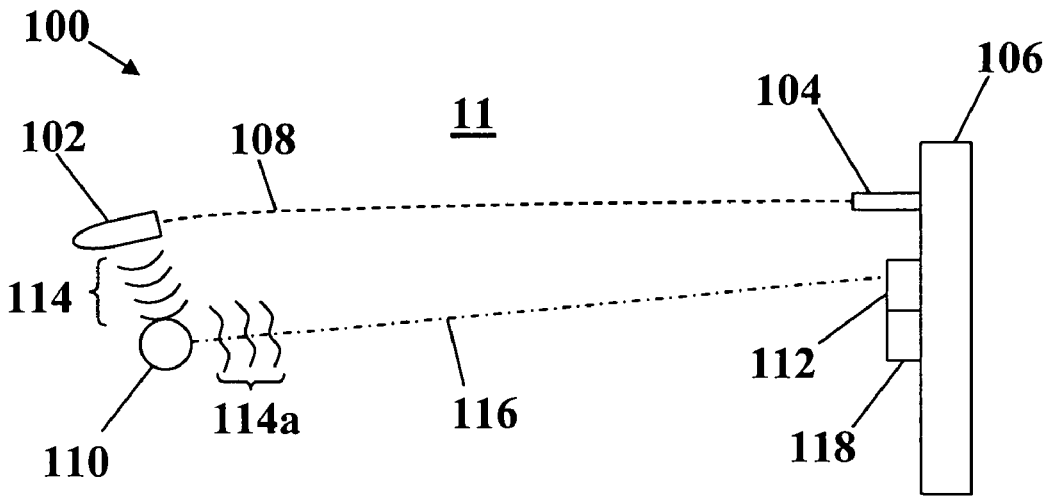
FIG. 4 illustrates a targeting, tracking system.

Referring to FIG. 4, there is shown a schematic representation of targeting system 100. For aid in targeting, system 100 utilizes projectile 102, which has a distinct acoustic signature produced by a rippling means, as described with relation to FIGS. 1, 2A-2C and 3A-3B. Projectile 102 is fired from gun 104 of platform 106. Gun 104 is aimed along a trajectory, indicated by dashed line 108, which is estimated to intercept target 110. Sensor 112 records the track of projectile 102 along trajectory 108. As described previously herein, sensor 112 can be sensitized to the acoustic characteristics of projectile 102, so as to preferentially track the distinct acoustic signal 114 of projectile 102 amidst other acoustic energy within medium 11.

As illustrated in FIG. 4, projectile 102 does not intercept target 110. However, projectile 102 does approach target 110 such that sensor 112 receives an additional echo (schematically illustrated as arcs 114*a*) of the distinct acoustic signal of projectile 102 along path 116. As is known in the art, such an echo, combined with the acoustic track of projectile 102, contains information about the relative distance of projectile 102 to target 110. Processors 118, optimized for the distinct acoustic signature of projectile 102, can resolve the path of projectile 102 and hence the relative distance between projectile 102 and target 110 at closest approach. In turn, the relative distance information can be used for targeting a next set of projectiles, in a manner similar to the use of tracer bullets in resolving a target on land.

Figure 5A:
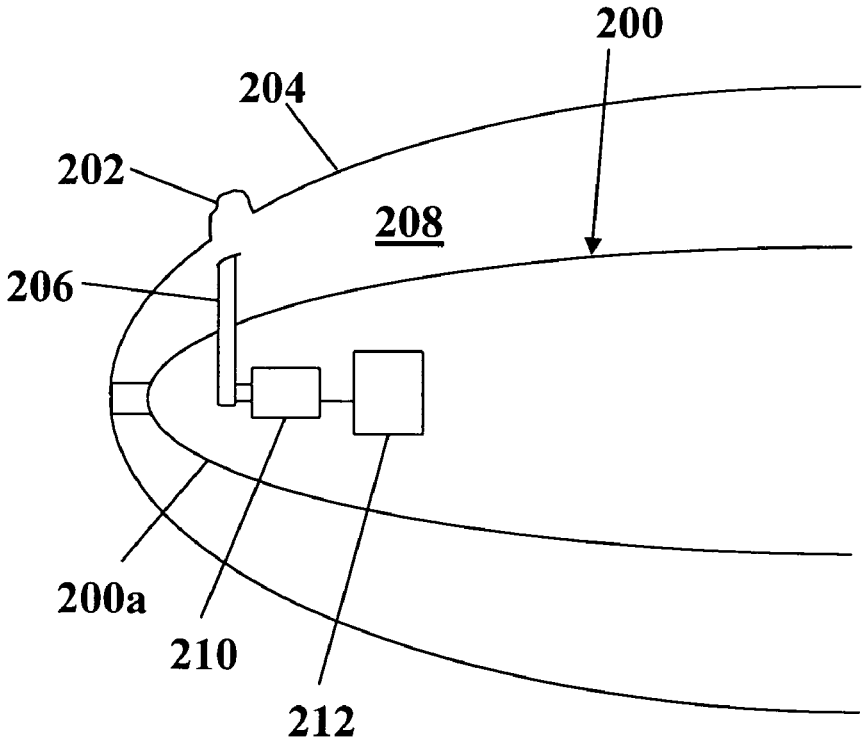
FIGS. 5A-5C illustrate actuator rippling means.

Referring now to FIGS. 5A-5C and FIG. 6, the operation of various rippling means is schematically represented and described. FIG. 5A illustrates a schematic cross-section of a nose portion 200*a* of projectile 200. To form disturbance 202 on cavity boundary 204, actuator 206 extends from nose portion 200*a* into cavity 208 towards cavity boundary 204. In so doing, actuator 206 disturbs the flow within cavity 208. In turn, the disturbed flow creates disturbance 202 on cavity boundary 204.

Control mechanism 210 can be linked to actuator 206 and can control the timing and/or the extent of actuator 206 into cavity 208. Power supply 212 provides power for the operation of control mechanism 210 and actuator 206. The dynamics of cavity boundary 204 are well known and understood in the art. Thus, the shape and timing of disturbance 202 can be controlled. Further, control mechanism 210 can be preprogrammed to provide the well-defined series of disturbances 18, as illustrated in FIGS. 2A-2C and FIGS. 3A and 3B.

Figure 5B:
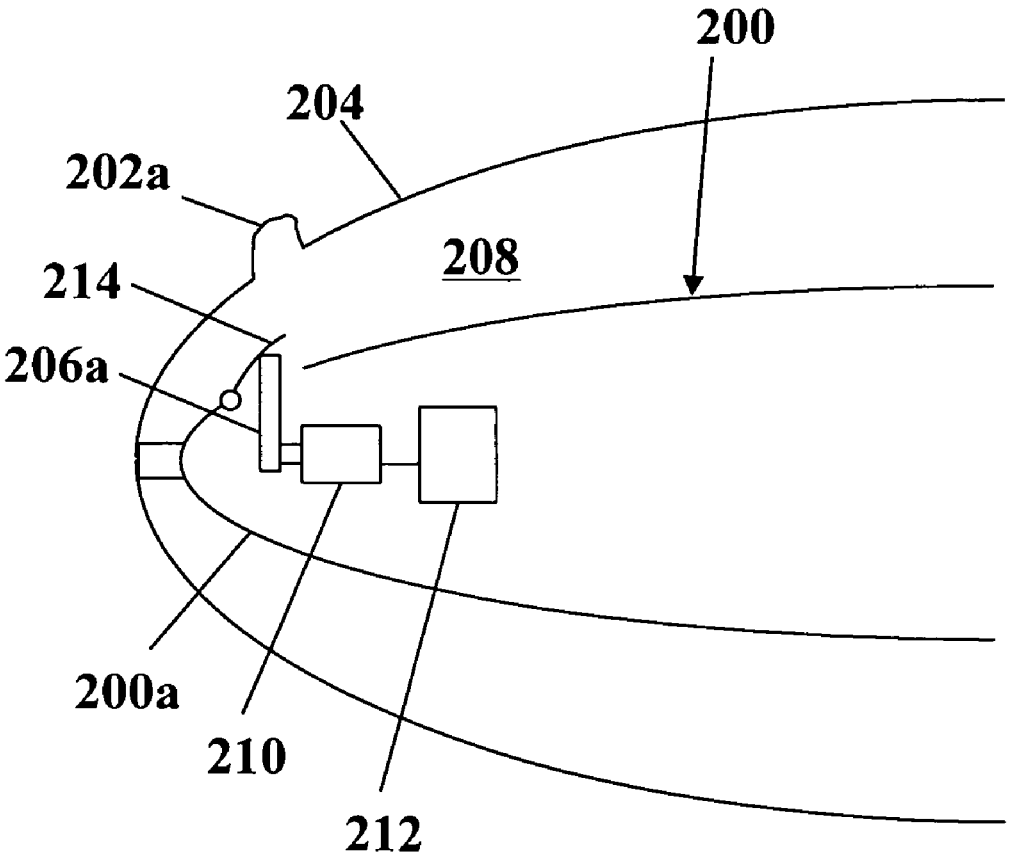
Figure 5C:
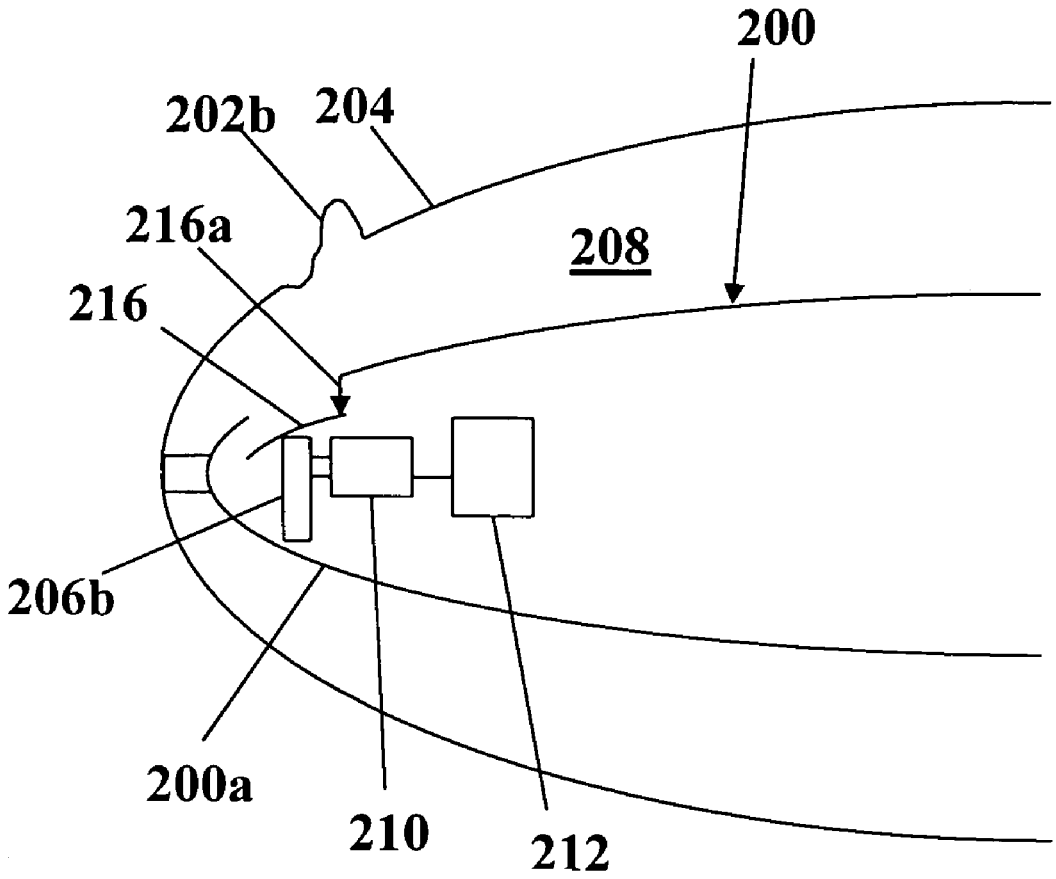

The shape and operation of actuator 206 can take many forms. FIG. 5B illustrates actuator 206*a* pivoting control surface 214 into cavity 208 to form disturbance 202*a*. FIG. 5C illustrates actuator 206*b* opening port 216 in projectile 200, in the direction of arrow 216*a*, so as to form disturbance 202*b*. Based on the particular acoustic signature required, one or more of actuators 206, 206*a*, 206*b*, may be used.

Figure 6:
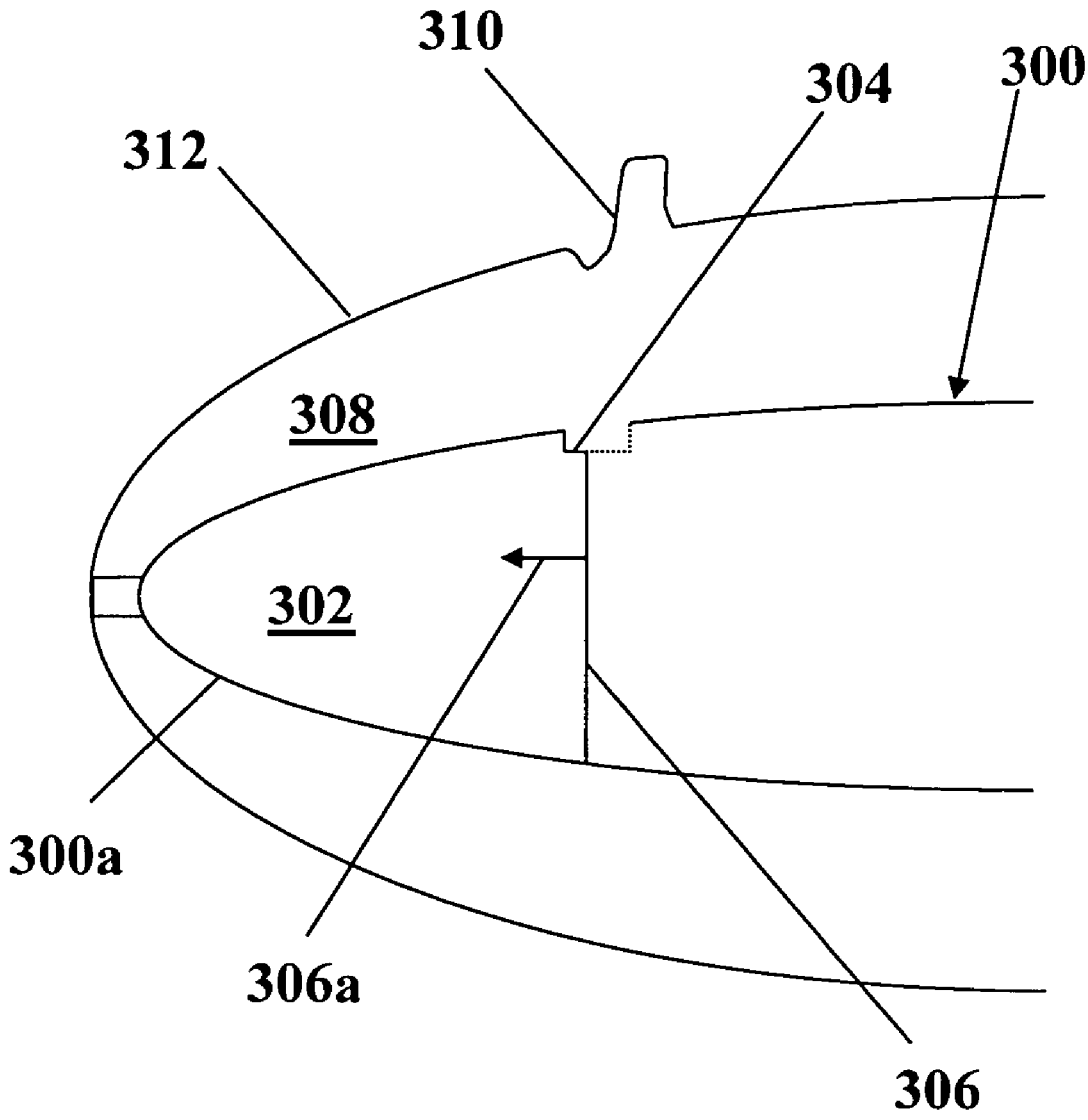
FIG. 6 illustrates a pressure disturbance rippling means.

The use of flammable cores in underwater supercavitating projectiles is known in the art. Such projectiles can be modified to produce distinct acoustic signatures. FIG. 6 illustrates a schematic cross-section of a nose portion 300*a* of modified projectile 300 having flammable core 302. Core 302 is penetrated by one or more bores 304. Upon launch of projectile 300, flammable core 302 is ignited. Combustion of core 302 results in flame front 306 advancing toward nose portion 300*a* of projectile 300, as indicated by arrow 306*a*. As flame front 306 reaches bore 304, the flow within cavity 308 is disturbed. (A portion of bore 304 is shown dotted to illustrate the passage of flame front 306.) In turn, the disturbed flow creates disturbance 310 on cavity boundary 312.

The number and size of bores 304 can be chosen to produce disturbances 310 of varying size and frequency. Additionally, the rate of propagation of flame front 306 can depend on the composition of flammable core 302. Accordingly, the rate of formation of disturbances 310 can vary depending on the composition of core 302. Thus, a desired acoustic signature can be generated depending on the size and location of bores 304 and/or the composition of core 302.

What have thus been described are systems and methods for providing well-defined, prescribed disruptions to the cavity boundary of a supercavitating projectile as it advects through a medium. The disruptions, in turn, lead to the formation of a distinct pattern of vapor bubbles, which burst as they trail behind the advecting projectile. This produces well characterized acoustic signals that contain unique features that interact with the acoustic environment and aid in the targeting of underwater objects.

To produce the disruptions to the cavity boundary; the projectile includes one or more rippling means, which disturb the flow within the cavity. The disturbed flow results in the disruptions of the cavity boundary. The rippling means can include mechanical actuators under preprogrammed control. The actuators can disturb the flow within the cavity by being extended into the cavity, by pivoting a control surface to interact with the flow, or by opening a port within the projectile. In a projectile having a flammable core, the core can be penetrated by one or more bores. Once the core is ignited, the passing of the flame front by such a bore results in the disturbance to the flow within the cavity.

In use, such a modified projectile is launched towards a target. Based on its distinct acoustic signature, acoustic sensors and processors can be attuned to better track and resolve the path of the projectile. When the projectile approaches the target, the echo of the projectile's acoustic signature from the target can also be tracked and resolved by the attuned sensors and processors. Combined with the projectile tracking information, the echo information is processed to determine a relative distance between the projectile and the target. This information can then be used for aiming additional projectiles at the target.

The systems and methods described herein provide for an enhanced ability to determine the near instantaneous track of an underwater object and to more accurately determine the instantaneous position of an underwater object. This is accomplished by providing means to control the spectrum and the amplitude of the radiated noise from a projectile.

Obviously many modifications and variations of the present invention may become apparent in light of the above teachings. As described previously, the shape of the actuator may be varied to suit the desired acoustic signature, or the extent to which the actuator interacts with the cavity flow may be varied. The location and size of the bores, as well as the composition of the flammable core can be varied to suit. Further, one or more of the actuators and the flammable core may be used in combination.

Additionally, it is known in the art that a tumbling projectile produces a robust, distinctive acoustic signature. The actuator or the final bore may be used to tumble the projectile at a fixed time or point in its trajectory to provide an especially strong acoustic signal for processing.

As another example, it is known in the art to have the projectile introduce gas into the cavity so as to maintain the closure region of the cavity further from the projectile. Such a projectile may be fitted with one, or more ports for releasing compressed gas into the flow so as to form disturbances along the cavity boundary.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. An underwater targeting system, comprising:

a supercavitating projectile capable of being launched towards a target;

a means for causing a ripple positioned in said projectile for providing the projectile with a distinct acoustic signal;

an acoustic sensor positioned remote from said projectile and capable of receiving first acoustic signals based on said distinct acoustic signal, said acoustic sensor further being capable of receiving second acoustic signals based on an echo of said distinct acoustic signal from the target; and an acoustic processor operatively joined to said acoustic sensor and capable of resolving a trajectory of said projectile based on said first acoustic signals and resolving a relative distance between said projectile and the target based on said first and second acoustic signals.

2. The system of claim 1, wherein said acoustic processor is attuned to said distinct acoustic signal for preferentially resolving said trajectory and said relative distance.

3. The system of claim 1, wherein said acoustic sensor is attuned to said distinct acoustic signal for preferentially receiving said first and second signals.

4. The system of claim 3, wherein said acoustic processor is attuned to said distinct acoustic signal for preferentially resolving said trajectory and said relative distance.

5. The system of claim 1, wherein said means for causing a ripple is capable of forming at least one disturbance at a cavity boundary of said supercavitating projectile, said at least one disturbance separating from said cavity boundary to form at least one vapor bubble in a wake of said supercavitating projectile, collapse of said at least one vapor bubble resulting in said distinct acoustic signal.

6. The system of claim 1, wherein said means for causing a ripple is programmed to form a predetermined series of disturbances in a cavity boundary of said supercavitating projectile, said disturbances having at least one of a specified timing, shape and size.

7. The system of claim 1, wherein said means for causing a ripple comprises:

an actuator positioned adjacent to an exterior of said supercavitating projectile; and a controller joined to said actuator to direct movement of said actuator to disturb a flow within a cavity surrounding said projectile.

8. The system of claim 7, wherein said controller extends said actuator into said flow.

9. The system of claim 7, further comprising a control surface joined to said actuator and the exterior of said projectile, wherein movement of said actuator pivots said control surface into said flow.

10. The system of claim 7, wherein:

said exterior of said projectile has a positionable port formed therein and joined to said actuator; and movement of said actuator opens said port of said projectile to said flow.

11. The system of claim 1, wherein said means for causing a ripple comprises a flammable core within said projectile, said projectile having at least one bore formed in an exterior surface extending to said flammable core, said at least one bore capable of exposing said core to a cavity surrounding said projectile, whereby passage of a flame front of said flammable core by said at least one bore disturbs a flow within the cavity.

12. The system of claim 11, wherein at least one of a size of said at least one bore, a location of said at least one bore and a flame rate of said flammable core form a predetermined series of disturbances.

13. An underwater, supercavitating projectile, comprising:

an actuator positioned adjacent to an exterior of said supercavitating projectile; and a controller directing movement of said actuator to disturb a flow within a cavity surrounding said supercavitating projectile;

wherein said exterior of said projectile has a positionable portion joined to said actuator; and movement of said actuator moves said positionable portion from a position wherein said positionable portion is flush with the exterior of said projectile to a position wherein said positionable portion is indented from the exterior of said projectile defining a cavity capable of interrupting said flow.

14. An underwater, supercavitating projectile, comprising a flammable core within said projectile, said projectile having at least one bore, said at least one bore exposing said core to a cavity surrounding said projectile, whereby passage of a flame front of said flammable core by said at least one bore disturbs a flow within the cavity, said disturbed flow forming at least one disturbance at a cavity boundary of said supercavitating projectile, said at least one disturbance separating from said cavity boundary to form at least one vapor bubble in a wake of said supercavitating projectile, and collapse of said at least one vapor bubble resulting in a distinct acoustic signature.

15. The system of claim 14, wherein at least one of a size of said at least one bore, a location of said at least one bore and a flame rate of said flammable core form a predetermined series of disturbances.

* * * * *